United States Patent [19]
Ricketts

[11] Patent Number: 4,560,206
[45] Date of Patent: Dec. 24, 1985

[54] METHOD FOR EXPLOSIVELY EXPANDING A PILLAR

[75] Inventor: Thomas E. Ricketts, Grand Junction, Colo.

[73] Assignee: Occidental Oil Shale, Inc., Grand Junction, Colo.

[21] Appl. No.: 517,363

[22] Filed: Jul. 26, 1983

[51] Int. Cl.[4] ..... E21C 41/00
[52] U.S. Cl. ..... 299/2; 299/13; 299/19; 299/11
[58] Field of Search ..... 299/2, 13, 19, 11; 166/259; 102/311, 312

[56] References Cited

U.S. PATENT DOCUMENTS

| | | | |
|---|---|---|---|
| 3,466,094 | 9/1969 | Haworth et al. | 299/13 |
| 3,509,726 | 5/1970 | White | 405/259 |
| 3,661,423 | 5/1972 | Garret | 299/2 |
| 4,281,877 | 8/1981 | Sass | 102/311 |
| 4,300,800 | 11/1981 | Ricketts | 299/2 |
| 4,353,598 | 10/1982 | Ricketts | 299/2 |
| 4,372,615 | 2/1983 | Ricketts | 299/2 |
| 4,440,447 | 4/1984 | Ricketts et al. | 299/2 |
| 4,449,553 | 5/1984 | Ricketts et al. | 299/2 |
| 4,453,769 | 6/1984 | Ricketts et al. | 299/2 |

OTHER PUBLICATIONS

*Blaster's Handbook,* 15 ed., E. I. du Pont de Nemours & Co., Inc., 1980, pp. 412–420.
"Large Scale Experimentation in Oil Shale", Zambus, Haworth and Sellers, *Transactions of the Society of Mining Engineers,* Sep. 1972.

*Primary Examiner*—Stephen J. Novosad
*Assistant Examiner*—Michael Goodwin
*Attorney, Agent, or Firm*—Christie Parker & Hale

[57] ABSTRACT

An in situ oil shale retort is formed in a retort site in a subterranean formation containing oil shale. The in situ retort contains a fragmented permeable mass of formation particles containing oil shale within top, bottom and generally vertically extending side boundaries of unfragmented formation. Formation is excavated to form at least one void in the subterranean formation while leaving zones of unfragmented formation above and below such a void and at least one support pillar of unfragmented formation in the void. Such a pillar of unfragmented formation extends between the zones of unfragmented formation above and below the void and is explosively expanded by use of techniques which minimize shock damage to the zones of unfragmented formation. The techniques, which can be used individually or in various combinations, include placing explosive charges into the top, bottom and middle portions of the pillar. Explosive charges in the middle portion are detonated first, thereby explosively expanding at least a first segment of the middle portion toward the void. Such a first segment is substantially an entire horizontal cross section of the pillar. Thereafter, all of the remaining explosive charges in the pillar are detonated. If desired, the explosive charges in the middle portion can be more energetic than the charges in the top and bottom portions.

Prior to explosively expanding the pillar, a fracture is formed between the top and bottom portions of the pillar and overlying and underlying zones of unfragmented formation to decouple the pillar from the formation. Additionally, when the roof of the void is the top boundary of the retort being formed, a plurality of rock bolts are placed into the zone of unfragmented formation overlying the void at angles toward such a support pillar so that at least a portion of such rock bolts converge in the formation directly above the pillar.

48 Claims, 9 Drawing Figures

METHOD FOR EXPLOSIVELY EXPANDING A PILLAR

This invention relates to a method for forming an in situ oil shale retort in a subterranean formation containing oil shale. More particularly this invention relates to techniques for explosively expanding pillars of unfragmented formation left within a void space in the formation which result in minimizing damage to unfragmented formation above and below such pillars.

BACKGROUND OF THE INVENTION

The presence of large deposits of oil shale in the semi-arid, high plateau region of the western United States has given rise to extensive efforts to develop methods for recovering shale oil from kerogen in the oil shale deposits. The term "oil shale" as used in the industry is, in fact, a misnomer; it is neither shale nor does it contain oil. It is a sedimentary formation comprising marlstone deposit containing an organic polymer called "kerogen" which, upon heating, decomposes to produce liquid and gaseous products, including hydrocarbon products. It is the formation containing kerogen that is called "oil shale" herein; the carbonaceous liquid product is called "shale oil".

A number of methods have been proposed for processing oil shale which involve either mining the kerogen-bearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded toward one or more voids excavated in the subterranean formation to form a fragmented permeable mass of formation particles containing oil shale in the retort. The fragmented mass of particles is ignited near the top of the retort to establish a combustion zone. An oxygen-supplying gas is introduced into the top of the retort to sustain the combustion zone and cause it to move downwardly through the fragmented mass. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett which is incorporated herein by this reference.

As used herein, the term "retorting zone" refers to that portion of the retort where kerogen in oil shale is being decomposed to liquid and gaseous products, leaving residual carbonaceous material in the retorted oil shale. The term "combustion zone" refers to a portion of the retort where the greater part of the oxygen in the retort inlet mixture that reacts with the residual carbonaceous material in the retorted oil shale is consumed.

There are several mining techniques that can be used for forming an in situ oil shale retort. One such technique includes excavating one or more generally horizontally extending box-shaped voids into the formation. The box-shaped voids are spaced vertically apart from each other by zones of unfragmented formation that extend between the voids. The zones of unfragmented formation provide generally horizontal free faces above and below the voids towards which the formation is explosively expanded to form the fragmented mass of formation particles in the retort. Pillars of unfragmented formation (hereinafter called "support pillars") can remain in the voids to support overlying formation during excavation, drilling and blasthole loading operations. Such support pillars are explosively expanded into the voids just prior to the explosive expansion of the zones of unfragmented formation.

Information regarding techniques for explosively expanding zones of unfragmented formation toward horizontal free faces for forming a fragmented mass of formation particles in a retort, including techniques for explosively expanding support pillars, can be found in my U.S. Pat. No. 4,300,800. U.S. Pat. No. 4,300,800 is incorporated herein by this reference.

When unfragmented formation is explosively expanded, e.g., toward a void space when forming a retort, it increases in bulk due to void spaces in interstices between the particles. The maximum expansion of an oil shale formation into an unlimited void results in a fragmented mass of oil shale particles having an average void fraction of about 35 percent; that is, about 35 percent of the total volume occupied by the fragmented mass is void space between the particles. The volume occupied by the fragmented mass is about 55 percent larger than the volume occupied by the original unfragmented formation after such unlimited or free expansion.

A "limited void" is one where the void space available for explosive expansion is less than needed for free bulking of the formation expanded toward that void. Thus, if a void has an excavated volume less than about 35 percent of the total of the volume of the void plus the volume occupied by formation explosively expanded, it is necessarily a limited void. It has been found that factors in addition to total available void can make a void "limited" even though the total available void may appear sufficient for free bulking.

When oil shale is explosively expanded toward a limited void, the void fraction of the fragmented mass of particles formed can be no more than permitted by the available void space of the void and, in some instances, has been found to be less. It is believed that the void fraction of the fragmented mass can be less than the available void space provided by such a limited void because when oil shale is explosively expanded toward the void, gases from the detonation may not have full opportunity to act on the oil shale particles before such particles reach obstructions, such as adjacent walls, a face opposite to the expanding formation, or oil shale expanding from the opposite sides of the void.

Thus, when formation is expanded toward one or more limited voids for forming an in situ oil shale retort, a void space can remain in the completed retort between the top surface of the fragmented mass of particles formed and overlying unfragmented formation, i.e. the retort top boundary.

During the retort ignition process, hot oxygen supplying gases are directed into the void space or plenum at the top of the retort to contact the top surface of the fragmented mass and ignite it. So that the ignition of the fragmented mass can be uniform, it is important that no material falls from the retort top boundary into the void space. For example, material that falls from the top boundary can prevent ignition gases from contacting and igniting the fragmented mass surface on which the fallen material rests. This results in a non-uniform combustion zone and can reduce the yield of products from the retorting operation. Additionally, such material can inhibit uniform gas flow through the fragmented mass during retorting operations by changing gas flow patterns in the plenum. Such non-uniform gas flow can result in inefficiencies in the retorting operation thereby reducing product yield.

When an in situ oil shale retort is formed using the above described horizontal free face blasting technique, it can be desired that the roof of the uppermost void excavated into the formation be the top boundary of the retort. Thus, the roof of such a void overlies the fragmented mass of formation particles that is eventually formed within the retort boundaries. Since the roof of such a void is the top boundary of the retort and it is important that no material falls from the top boundary into the void, it is desired that the roof is not structurally damaged during the support pillar blasting operation. For example, in one prior horizontal free face blasting operation used for forming an in situ retort where a pair of support pillars was explosively expanded into the uppermost void, large slabs and blocks of formation from the retort top boundary fell onto the top surface of the fragmented mass in the completed retort. Since the locus of these slabs and blocks was at the original locus of the two support pillars and the section of roof between the pillars, it is thought that detonation of the explosive charges in the pillars damaged the unfragmented formation between and above them sufficiently to cause the massive rock fall.

Additionally, it is important that the zones of unfragmented formation located above and/or below such a support pillar that are to be explosively expanded for forming the fragmented mass in the retort are not fractured or damaged by the pillar blasting operation. Such damage can result in the fragmented mass formed by explosive expansion of such zones of unfragmented formation having a non-uniform particle size distribution and/or a non-uniformly distributed void fraction.

Furthermore, when such support pillars are located in the lowermost void space in the subterranean formation blasting such pillars can fracture or weaken underlying formation; for example formation adjacent product withdrawal drifts. This can result in collapse of material into the withdrawal drifts thus hindering product recovery operations.

Therefore, there is a need in the art for a support pillar blasting method that minimizes blast damage to formation adjacent the pillars.

SUMMARY OF THE INVENTION

This invention relates to a method for forming an in situ oil shale retort in a subterranean formation containing oil shale and more particularly to techniques for explosively expanding support pillars of unfragmented formation left within a void space in the subterranean formation which results in minimizing damage to unfragmented formation above and below such pillars. The situ retort contains a fragmented permeable mass of formation particles containing oil shale within top, bottom and generally vertically extending side boundaries of unfragmented formation. Formation is excavated to form at least one void in the subterranean formation while leaving zones of unfragmented formation above and below such a void and at least one support pillar of unfragmented formation in the void. Such a support pillar comprises three vertically spaced portions wherein each such portion comprises an entire horizontal cross section of the pillar; a top portion adjoining the overlying zone of unfragmented formation, a bottom portion adjoining the underlying zone of unfragmented formation and a middle portion extending between the top and bottom portions. Explosive charges are placed into at least one of the zones of unfragmented formation for explosively expanding such a zone toward the void. Explosive charges are also placed into the top, bottom and middle portions of the pillar for explosively expanding the pillar toward the void. The explosive charges are detonated to thereby form the fragmented permeable mass of formation particles in the retort by first detonating explosive charges in such a middle portion of the pillar to thereby explosively expand at least a first segment of the middle portion toward the void. The first segment is substantially an entire horizontal cross section of the middle portion of the pillar. Thereafter, all of the remaining explosive charges in the pillar are detonated followed by detonation of explosive charges in the zone of unfragmented formation.

In another technique provided in accordance with practice of this invention, a fracture is formed between the top portion of the pillar and the overlying zone of unfragmented formation prior to detonating explosive charges for explosively expanding the first segment of the middle portion of the pillar toward the void. Additionally, if desired, a fracture is formed between the bottom portion of the pillar and the underlying zone of unfragmented formation prior to detonating explosive charges for explosively expanding the first segment of the middle portion of the pillar toward the void.

In yet another technique provided in accordance with practice of this invention, the explosive charges in the middle portion of the pillar are more energetic than the explosive charges in either the top or bottom portions of the pillar.

Each of the above-described techniques provided in accordance with practice of this invention can be practiced alone or in various combinations with each other.

Additionally, where the roof of the uppermost void formed in a subterranean formation is the top boundary of the retort being formed, a plurality of rock bolts are placed into the roof of the uppermost void at angles toward such a support pillar in the void so that at least a portion of the rock bolts converge in the unfragmented formation directly above the pillar.

BRIEF DESCRIPTION OF THE DRAWINGS

These and other features, aspects and advantages of the present invention will be more fully understood when considered with respect to the following detailed description, appended claims, and accompanying drawings, wherein:

DETAILED DESCRIPTION

Figure 1:
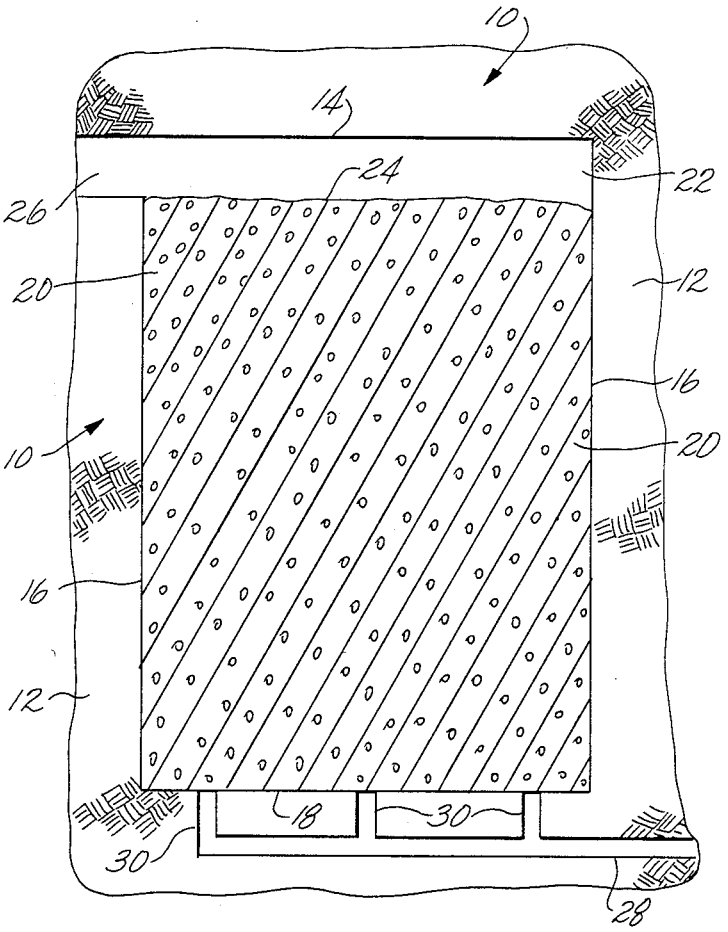
FIG. 1 is a fragmentary, semi-schematic, vertical cross sectional view of one embodiment of an in situ oil shale retort prepared in accordance with practice of principles of this invention.

Referring to FIG. 1, there is shown a fragmentary semi-schematic, vertical cross sectional view of one embodiment of an in situ oil shale retort 10 prepared in accordance with practice of principles of this invention. In an exemplary embodiment, the in situ retort 10 can be rectangular in horizontal cross section, e.g. square, however retorts having other shapes can also be formed if desired.

The in situ retort 10 is in a retort site in a subterranean formation 12 containing oil shale and has a generally horizontal top boundary 14, generally vertically extending side boundaries 16 and a bottom boundary 18 of unfragmented formation. Although the top boundary 14 of the exemplary embodiment is generally horizontal, top boundaries that are curved, e.g. dome shaped, are also contemplated.

A fragmented permeable mass 20 of formation particles is contained within the retort boundaries and a void space 22 is at the top of the retort between the top surface 24 of the fragmented mass and the top boundary 14.

One or more laterally extending drifts or retort inlets 26 extend into the retort at its top for introduction of ignition and retorting gases. For example, during ignition, hot gases are introduced through the inlet 26 into the void space 22 which acts as a plenum for distributing the hot gases across the surface 24 of the fragmented mass to ignite it. After ignition is complete, i.e. after a combustion zone is formed across an upper region of the fragmented mass, introduction of the hot gases is discontinued and a retorting gas, such as air or other oxygen-supplying gas, is introduced through the inlet 26 to sustain the combustion zone and to advance it downwardly through the retort. Although in the illustrated embodiment the inlet 26 is shown entering the retort at its side and adjacent the top boundary 14, such inlets can be vertical or at other angles extending into the top of the retort through overlying unfragmented formation.

In the illustrated embodiment, a drift 28 is at the bottom of the retort in fluid communication with the fragmented mass 20 by means of one or more raises 30 that extend upwardly from the drift 28 through unfragmented formation underlying the retort bottom boundary. The drift 28 and raises 30 provide for withdrawal of liquids and off gases from the retorting operation, including gaseous and liquid products of retorting.

An exemplary embodiment of a method provided in accordance with practice of this invention for forming the in situ retort 10 can be understood by referring to FIGS. 2–7 which are fragmentary semi-schematic views of the retort 10 at various stages during its formation.

The retort 10 is formed by a horizontal free face blasting technique in which formation is excavated to form at least one void within the boundaries of the retort site. Each such void extends horizontally across a different level of the retort site leaving zones of unfragmented formation above and below each void.

Figure 2:
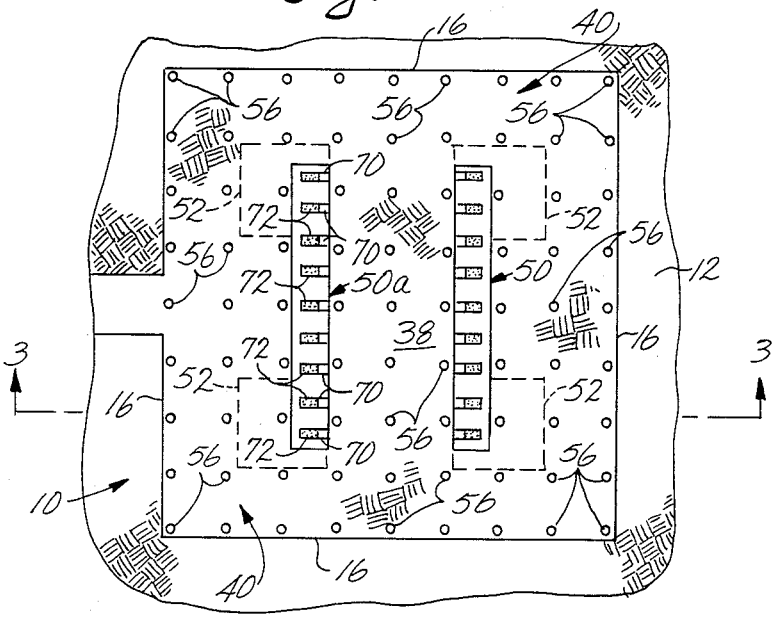
FIG. 2 is a fragmentary, semi-schematic, horizontal cross sectional view of the retort of FIG. 1 at one stage during its preparation taken on line 2—2 of FIG. 3.
Figure 3:
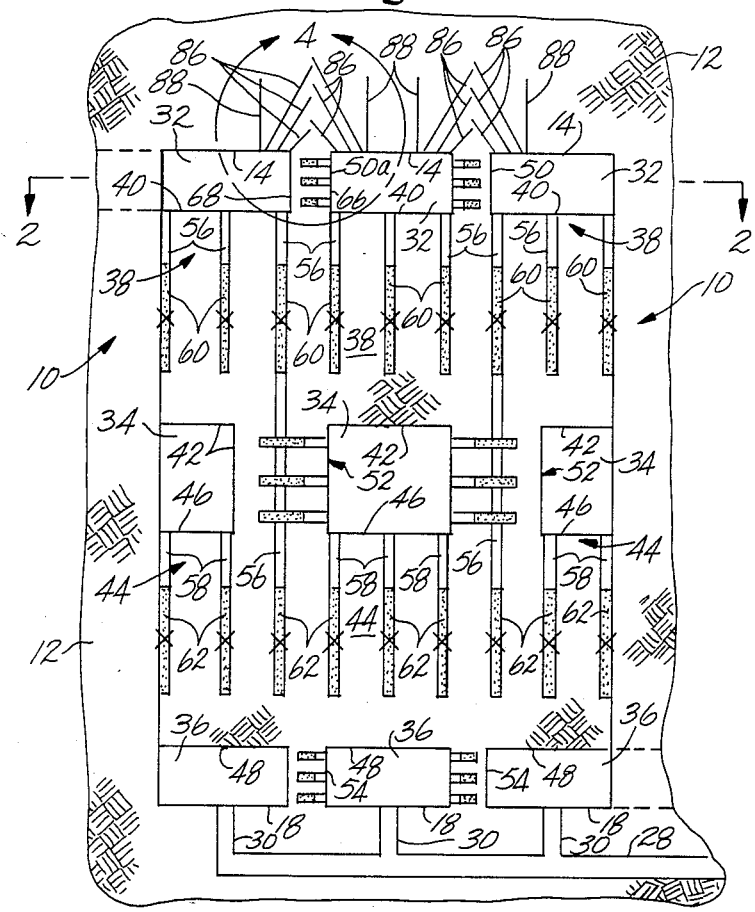
FIG. 3 is a fragmentary, semi-schematic, vertical cross sectional view taken on line 3—3 of FIG. 2.

Referring particularly to FIGS. 2 and 3, in an exemplary embodiment of practice of the horizontal free face blasting technique of this invention, three generally horizontally extending, rectangular box-shaped limited voids are excavated into the formation 12 one above the other within the retort boundaries; an upper level void 32, an intermediate level void 34, and a lower level void 36. A zone of unfragmented formation 38 extends from the floor 40 of the void 32 to the roof 42 of the void 34. Also, a zone of unfragmented formation 44 extends from the floor 46 of the void 34 to the roof 48 of the void 36. The roof of the void 32 is the top boundary 14 of the retort and the floor of the void 36 is the bottom boundary 18.

Retorts, such as the retort 10 can be several hundred feet long on each side and hundreds of feet tall. Thus, the roof of each such void excavated into the formation, i.e. the roof of each of the voids 32, 34 and 36, can span a considerable distance. Since such excavated voids can be used for blasthole drilling and loading operations it is desired that rock falls from the roof over such voids be prevented. Therefore, in accordance with practice of this invention, at least one pillar of unfragmented formation is left within each of the voids 32, 34 and 36 extending between the unfragmented formation overlying and underlying each such void to provide temporary roof support.

As is described below in greater detail, in a horizontal free face blasting technique such as the techniques provided in accordance with this invention, the fragmented mass of formation particles is formed in the retort by explosively expanding each of the pillars left in the excavated voids and also the zones of unfragmented formation adjacent the voids. In an exemplary embodiment, explosive expansion of the pillars and zones of unfragmented formation is completed in the same single round with the pillars explosively expanded first so that they do not impede explosive expansion of adjacent zones of unfragmented formation. A "single round" as used herein means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

An important feature of techniques provided in accordance with practice of this invention is that their use inhibits or prevents shock damage to unfragmented formation overlying and underlying support pillars that can result from pillar blasting operations.

For example, where, as in the illustrated embodiment, the roof of the void 32 is the top boundary 14 of the retort, it is important that formation overlying the boundary 14 is not damaged by explosive expansion of support pillars in the void 32. As is mentioned above, if formation overlying the top boundary is damaged it can collapse into the retort and inhibit the ignition and retorting operation.

Also, as in the illustrated embodiment, where the floor of the lowermost void 36 is the bottom boundary 18 of the retort and is adjacent a product withdrawal system, such as the withdrawal system comprising the drift 28 and the raises 30, it is desired that formation underlying such a void is not damaged by explosive expansion of pillars in the void. For example, if the formation containing the withdrawal system is damaged sufficiently it can collapse into the drift 28 and/or into one or more of the raises 30. Such a collapse can impede or prohibit product recovery and off gas withdrawal operations.

It is also desired that the unfragmented formation adjacent the pillars that is to be explosively expanded for forming the fragmented mass is not damaged by the pillar blasting operation. Such damage, as is mentioned above, can result in the fragmented mass formed by explosive expansion of such zones of unfragmented formation having a non-uniform particle size and/or a non-uniformly distributed void fraction.

As is described below in detail, the several techniques provided in accordance with this invention result in minimizing damage to formation overlying and underlying a pillar due to pillar blasting and also inhibit rock falls from the top boundary of the retort. The techniques can be practiced alone, if desired, or in combination.

In the illustrated embodiment, the upper void 32 includes a pair of laterally spaced apart, parallel, relatively long and narrow support pillars 50. The top of each of the pillars 50 adjoins the zone of unfragmented formation overlying the upper void 32, i.e., the top of each pillar 50 adjoins the top boundary 14 of the retort. The bottom of each support pillar 50 adjoins the zone of unfragmented formation 38 underlying the upper void.

The intermediate void 34 includes four laterally spaced apart support pillars 52 of generally square horizontal cross section (shown in dashed lines in FIG. 2). The top of each of the pillars 52 adjoins the zone of unfragmented formation 38 and the bottom of each of the pillars 52 adjoins the zone of unfragmented formation 44.

The lower void 36 includes a pair of laterally spaced apart, parallel relatively long and narrow pillars 54 similar to the pillars 50 in the upper void 32. The top of each of the support pillars 54 adjoins the overlying zone of unfragmented formation 44 and the bottom of each of the support pillars 54 adjoins the zone of unfragmented formation underlying the lower void 36, i.e. the bottom of each pillar 54 adjoins the bottom boundary 18 of the retort.

The number and shape of the support pillars in each of the voids is for illustrative purposes and more or fewer pillars of the same or different shape can be provided if desired.

The zones of unfragmented formation 38 and 44 are prepared for explosive expansion by drilling generally vertically extending blastholes into each such zone from the overlying voids and loading the blastholes with explosive charges. In an exemplary embodiment, a plurality of generally vertical blastholes 56 are drilled from the void 32 into the zone of unfragmented formation 38. Although the blastholes 56 are in a square array, i.e. an array where the spacing distance between each pair of adjacent blastholes is equal, arrays having other configurations can be used, if desired. Several of the blastholes 56 extend through each of the pillars 52 and are included in a square array of blastholes 58 drilled from the void space 34 into the zone of unfragmented formation 44.

Explosive is placed into the blastholes 56 and 58 to provide an array of explosive charges 60 in the zone of unfragmented formation 38 and an array of explosive charges 62 in the zone of unfragmented formation 44. Appropriate stemming (not shown) is provided in each of the blastholes 56 and 58.

Each of the explosive charges 60 and 62 is preferably at about the center of height of its respective zone of unfragmented formation and extends about one half the distance from its center to the adjacent voids. Each of the charges 60 and 62 is provided with a detonator designated by an "x" preferably at about the center of the charge for detonating the charge at the selected moment during the detonation sequence.

Thus, after the pillars 50, 52 and 54 in the upper, intermediate and lower voids respectively are explosively expanded in accordance with the techniques of this invention described in detail below, the explosive charges 60 and 62 are detonated for explosively expanding the zones of unfragmented formation 38 and 44. The zone 38 is explosively expanded upwardly toward a generally horizontal free face 40 provided by the floor of the void 32 and downwardly toward a generally horizontal free face 42 provided by the roof of the void 34. The zone 44 is explosively expanded upwardly toward a generally horizontal free face 46 provided by the floor of the void 34 and downwardly toward a generally horizontal free face 48 provided by the roof of the void 36.

Additional details of drilling vertical blastholes in unfragmented formation, placement of explosive charges and detonators into such blastholes and detonating the charges for explosively expanding zones of unfragmented 5 formation toward horizontal free faces are discussed in U.S. Pat. No. 4,300,800.

Prior to explosive expansion of the zones of unfragmented formation, the pillars 50, 52 and 54 are prepared for explosive expansion and are explosively expanded using techniques provided in accordance with this invention. Since the techniques are similar for each of the pillars in the voids 32, 34 and 36 such techniques are described in detail with regard to only one of the pillars, i.e. the pillar 50*a* in the void 32.

Referring to FIGS. 4–7 in addition to FIGS. 2–3, the pillar 50*a* has a pair of generally vertical walls 66 and 68 on its opposite sides along its length. The walls 66 and 68 provide free faces towards which the pillar is explosively expanded. An array of a plurality of spaced apart, generally horizontally extending primary blastholes 70 (best seen in FIGS. 2, 4 and 5) are drilled through one of the free faces into the pillar 50*a*. In the illustrated embodiment the blastholes are through the free face 66 and extend through about $\frac{3}{4}$ the thickness of the pillar. If desired, the blastholes can be formed through the other free face 68.

Each of the primary blastholes 70 is loaded with explosive to provide an array of primary explosive charges 72 with each charge preferably extending through about ½ the thickness of the pillar, i.e. each of the charges 72 extends from about the center of the pillar about ½ the distance to the adjacent free face. A detonator designated by an "x" (shown only in FIG. 4) is provided at about the center of each primary charge 72 to provide for detonation of such a charge in the proper sequence. The blastholes 70 are called "primary" blastholes since the charges 72 contained therein are used for explosively expanding the pillar toward the void. In another technique provided in accordance with this invention and described below in greater detail, a plurality of smaller blastholes and associated explosive charges are formed in the pillar to provide a pre-splitting function. The smaller blastholes used for pre-splitting are called "secondary" blastholes.

Figure 4:
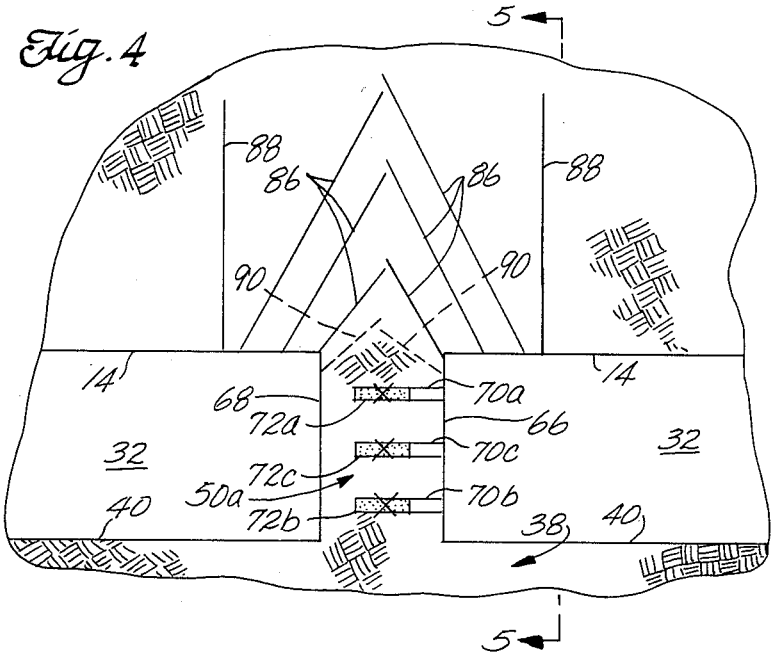
FIG. 4 is an enlarged view of a portion of the retort of FIG. 1 taken on line 4—4 of FIG. 3 including an enlarged view of a support pillar of unfragmented formation at one stage in its preparation for explosive expansion in accordance with an exemplary embodiment of practice of principles of this invention.
Figure 5:
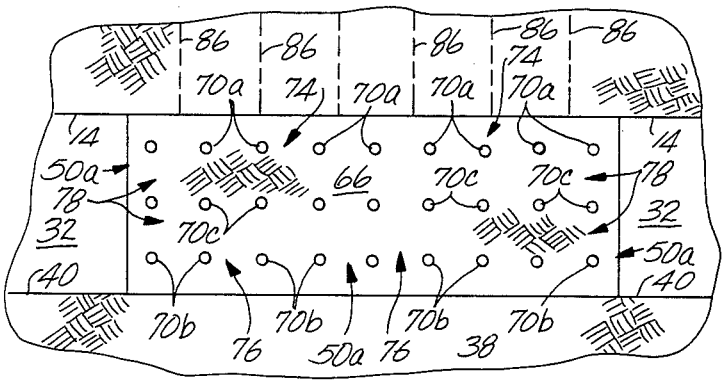
FIG. 5 is a fragmentary, semi-schematic, vertical cross sectional view taken on line 5—5 of FIG. 4.

As is best seen in FIGS. 4 and 5, the array of blastholes 70 includes a first generally horizontal row of primary blastholes 70*a* along the length of the top portion of the pillar and a second generally horizontal row of primary blastholes 70*b* along the length of the bottom portion of the pillar. Additionally, at least one intermediate row of primary blastholes 70*c* is along the length of a middle portion of the pillar between the first and second rows.

The pillar 50*a* is explosively expanded in portions wherein each such portion comprises an entire horizontal cross section of the pillar. For example, a top portion 74 of the pillar which adjoins the top boundary of the retort is explosively expanded by detonation of the explosive charges 72*a* in the row of blastholes 70*a*. A bottom portion 76 of the pillar which adjoins the underlying zone of unfragmented formation 38 is explosively expanded by detonation of the explosive charges 72*b* in the row of blastholes 70*b*. And, a middle portion 78 of the pillar, extending between the top and bottom portions, is explosively expanded by detonation of all of the explosive charges 72*c* in the one or more intermediate rows of blastholes 70*c*.

In a preferred detonation sequence all of the explosive charges in at least one of the intermediate rows are detonated first to thereby explosively expand at least a first segment of the middle portion of the pillar toward the void. Such a first segment comprises an entire horizontal cross section of the middle portion. After at least such a first segment of the middle portion of the pillar has been explosively expanded the remaining explosive charges in the pillar are detonated for expanding the rest of the pillar.

Explosively expanding at least such a first segment of the middle portion of the pillar before the remaining portions are expanded provides relief for expansion of such remaining portions. This reduces the amount of shock and resulting blast damage to unfragmented formation above and below the pillars.

In the illustrated embodiment there is one generally horizontal intermediate row of primary blastholes 70*c* extending along the length of the pillar at about its center of height. Both the rows 70*a* and 70*b* are about the same distance from the row 70*c* and the array that comprises the rows 70*a*, 70*b* and 70*c* is a square array.

Figure 6:
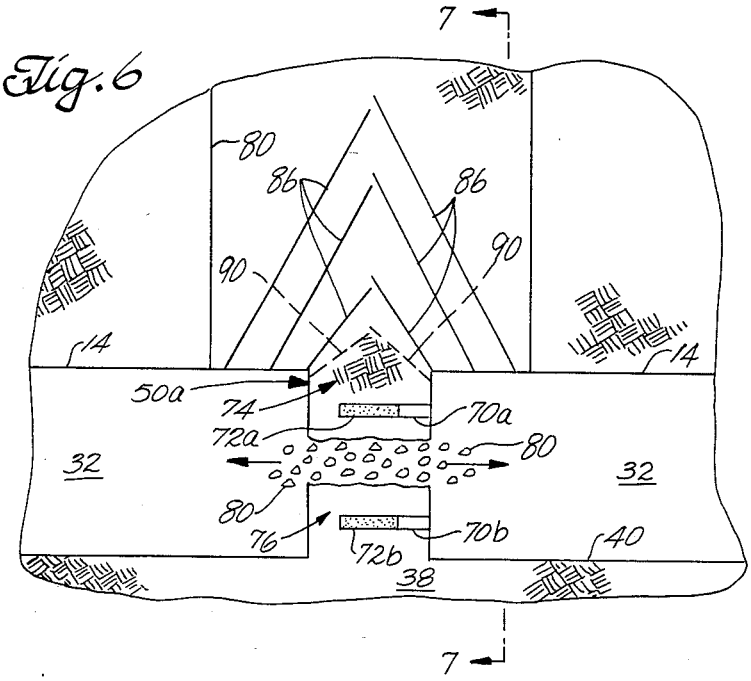
FIG. 6 is another view of the pillar shown in FIG. 4 at one stage, during its explosive expansion.
Figure 7:
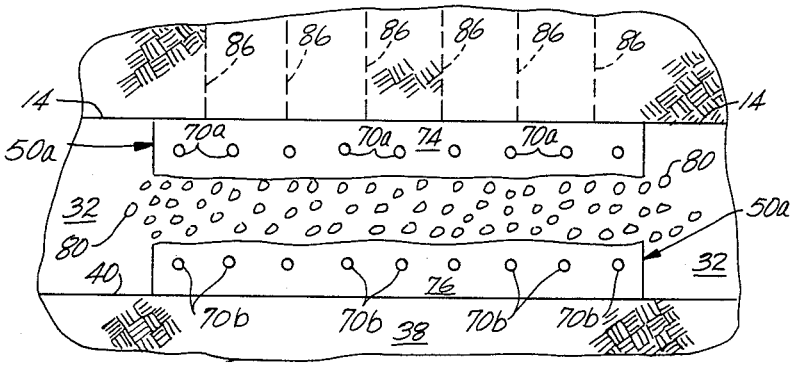
FIG. 7 is a fragmentary, semi-schematic, vertical cross sectional view taken on line 7—7 of FIG. 6.

In an exemplary embodiment of practice of this invention all of the explosive charges 72*c* in the row of blastholes 70*c* are detonated first to thereby explosively expand the middle portion 78 of the pillar. This is best seen in FIGS. 6 and 7 which shows the pillar 50*a* after the charges 72*c* in the blastholes 70*c* have been detonated, but before detonation of the charges 72*a* and 72*b* in the blastholes 70*a* and 70*b*. Pillar fragments 80 comprise what remains of the middle portion 78 after detonation of the charges 72*c* and such fragments 80 are shown in flight expanding into the void 32. After a selected time delay, preferably in the same single round, all of the explosive charges 72*a* in the row of blastholes 70*a* and all of the charges 72*b* in the row of blastholes 70*b* are detonated at the same time to thereby explosively expand the top and bottom portions of the pillar toward the void.

Preferably the selected time delay is from about 1 millisecond (ms) to about 10 ms per foot of spacing distance between both the top and bottom rows of blastholes and the intermediate row. If the time delay is less than about 1 ms per foot of spacing, formation from the middle portion of the pillar will not have moved sufficiently to provide the desired amount of relief for expansion of the top and bottom portions. Thus, shock damage will not be reduced to a desired extent. If the delay is longer than about 10 milliseconds per foot of spacing, proper distribution of pillar fragments within the void is not provided.

In another technique provided by practice of this invention for minimizing blast damage to formation overlying and underlying a pillar such as the pillar 50*a*, a relatively higher shock energy explosive is used for explosively expanding the middle portion of the pillar and a relatively lower shock energy explosive is used for explosively expanding the top and bottom portions.

For example, a relatively high shock energy explosive such as that provided by Ireco Chemical Company of Salt Lake City, Utah under the trademark IRETOL 37 T 22 or other high shock energy explosive can be placed into the blastholes 70*c* in the pillar 50*a* and ANFO prill, a relatively low shock energy explosive can be placed into the blastholes 70*a* and 70*b*. The lower energy explosive ANFO prill provides lower peak pressures and a lower burning rate than does IRETOL 37 T 22. Thus, use of ANFO or a similar low shock energy explosive in the top and bottom portions of the pillar results in a shock wave of less magnitude reaching the formation overlying and underlying the pillar than would be the case if IRETOL 37 T 22 or another high shock energy explosive were used. Thus, using a low shock energy explosive in the blastholes 70*a* and 70*b* results in less shock damage to the unfragmented formation above and below the pillars than is the case when a high shock energy explosive is used.

Figure 8:
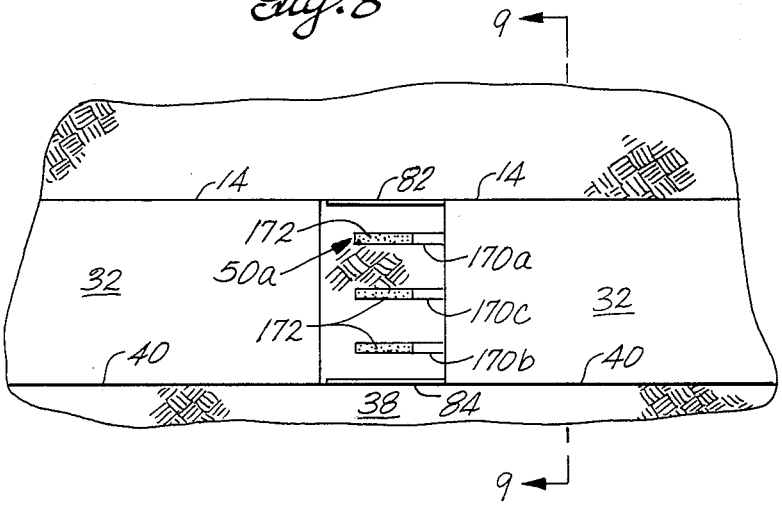
FIG. 8 is a fragmentary, semi-schematic, vertical cross sectional view of the pillar shown in FIG. 4, at one stage in its preparation for being explosively expanded in accordance with another exemplary embodiment of practice of principles of this invention.
Figure 9:
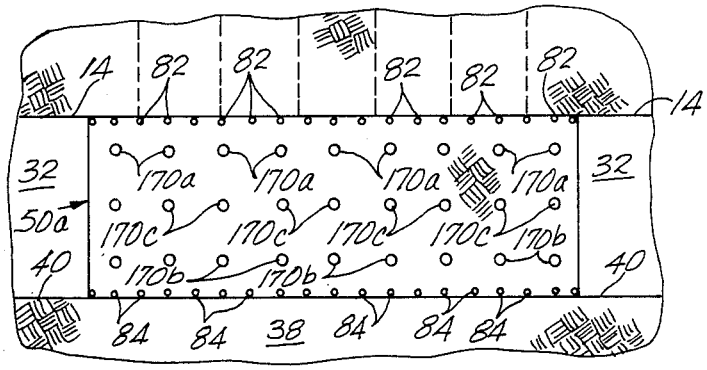
FIG. 9 is a fragmentary, semi-schematic, vertical cross sectional view taken on line 9—9 of FIG. 8.

Turning now to FIGS. 8 and 9, in yet another exemplary technique provided by practice of principles of this invention, the top and/or bottom of the pillar 50*a* is decoupled from the unfragmented formation overlying and underlying it by a pre-splitting operation prior to explosive expansion of the pillar.

Details of general methods for such pre-splitting or pre-shearing can be found in *THE BLASTER'S HANDBOOK*, E. I. DuPont de Nemours & Co. (Inc.), 15th Edition (1942), pages 412–420. Pages 412–420 of The Blaster's Handbook are incorporated herein by this reference.

In the embodiment illustrated in FIGS. 8 and 9, the pillar 50*a* includes an array of blastholes 170 similar to the array of blastholes 70 shown in FIGS. 4 and 5. Thus a row of primary blastholes 170*a* is along the top portion of the pillar, a row of primary blastholes 170*b* is along the bottom portion of the pillar and a row of primary blastholes 170*c* is along a middle portion of the pillar between the top and bottom rows. Explosive charges 172 are in the blastholes 170. In addition to the primary blastholes, a row of secondary blastholes 82 is formed along the length of the pillar 50*a* at about the top of the pillar and a row of secondary blastholes 84 is formed along the length of the pillar at its bottom.

The blastholes 82 and 84 extend through about the entire thickness of the pillar and are more closely spaced together than are the blastholes 170. Additionally, the blastholes 82 and 84 are relatively lightly loaded with explosive compared to the amount of explosive that comprises each of the charges 172 in the primary blastholes 170. The light loads of explosive, for instance, can comprise a plurality of spaced apart, full or partially full, cartridges of dynamite on a detonating cord lead which extends into each such blasthole 82 and 84. If desired, a continuous column of very low energy explosive can also be used.

When such a pre-splitting technique is used, all of the explosive charges in the secondary blastholes, i.e. all of the charges in the rows 82 and 84, are detonated to form a fracture between both the top and bottom of the pillar and overlying and underlying unfragmented formation before any of the explosive charges in the primary blastholes are detonated. The pre-split charges can be detonated a short time, for example, 10 to 100 milliseconds before the explosive charges 172 in the primary blastholes 170 are detonated.

Detonation of the pre-split charges in the blastholes 82 and 84 causes only a small amount of overbreak because of their relatively low energy. The close spacing of the secondary blastholes, however, causes a fracture to form between the blastholes creating a gap at planes along both the top and bottom of the pillar in which the secondary blastholes are drilled. Thus, when the primary explosive charges 172 in the primary blastholes 170 are detonated, the shock wave from the charges 172 is effectively decoupled from the overlying and underlying formation because of the intervening fractures above and below the pillar. This tends to minimize damage to unfragmented formation adjacent the top and bottom of the pillars.

Referring again to FIG. 3, the other pillar 50 in the void 32, the pillars 52 in the void 34 and the pillars 54 in the void 36 are prepared for explosive expansion and are explosively expanded using one or more of the techniques described above for preparing and explosively expanding the pillar 50*a*. As is mentioned above, each of these techniques can be used alone or in combination.

After the pillars in all of the voids are explosively expanded, the explosive charges 60 in the zone of unfragmented formation 38 and the explosive charges 62 in the zone of unfragmented formation 44 are detonated to explosively expand the zones 38 and 44 toward the voids. Preferably the explosive expansion of the zones of unfragmented formation and the explosive expansion of the pillars is accomplished in the same single round of detonations.

If desired, in addition to the techniques described above for minimizing the amount of shock damage to unfragmented formation above the pillars 50 in the upper void 32, i.e. to minimize shock damage to the top boundary 14 of the retort, a rock bolting technique is provided in accordance with practice of this invention to inhibit rock falls from the top boundary.

For example, in accordance with this invention, a plurality of rock bolts 86 (best seen in FIGS. 3–7) can be placed into the zone of unfragmented formation overlying the void 32. The rock bolts 86 are placed in holes drilled into the top boundary 14 from the void 32 at angles toward the pillars 50 such that the rock bolts tend to converge in the formation overlying the pillars. Additionally, rock bolts 88 can be employed in holes drilled vertically through the roof from the void 32 for stabilizing portions of the roof that do not overlie the pillars. Rock bolts 90 (shown in dashed lines in FIGS. 4 and 6) can also be placed in holes drilled diagonally upwardly through a wall of the pillars 50 into formation overlying the pillar. Collectively, such rock bolts augment the strength of formation overlying the void space 22 in the completed retort 10 (shown in FIG. 1) thereby minimizing the likelihood of substantial rock falls from the void roof.

The above description of methods for explosively expanding pillars to minimize damage to unfragmented formation above and below the pillars and the rock bolting technique for stabilizing the top boundary of a retort are for illustrative purposes. Because of variations which will be apparent to those skilled in the art, the present invention is not intended to be limited to the embodiments described above. The scope of the invention is defined in the following claims.

What is claimed is:

1. A method for forming an in situ oil shale retort in a retort site in a subterranean formation containing oil shale, the in situ oil shale retort containing a fragmented permeable mass of formation particles containing oil shale within top, bottom, and generally vertically extending side boundaries of unfragmented formation, the method comprising the steps of:

(a) excavating at least one void within the retort boundaries in the subterranean formation while leaving zones of unfragmented formation above and below such a void and at least one support pillar of unfragmented formation in the void, such a support pillar comprising three vertically spaced portions wherein each such portion comprises an entire horizontal cross section of the pillar, a top portion adjoining the overlying zone of unfragmented formation, a bottom portion adjoining the underlying zone of unfragmented formation and a middle portion extending between the top and bottom portions;

(b) placing explosive charges into at least one of the zones of unfragmented formation for explosively expanding such a zone toward the void;

(c) placing explosive charges into the top, bottom, and middle portions of the pillar for explosively expanding the pillar toward the void;

(d) detonating the explosive charges to thereby form the fragmented permeable mass of formation particles in the retort by the steps of:

(i) detonating explosive charges in such a middle portion of the pillar to thereby explosively expand at least a first segment of the middle portion toward the void, the first segment being substantially an entire horizontal cross section of the middle portion; thereafter (ii) detonating all of the remaining explosive charges in the pillar; and thereafter, (iii) detonating the explosive charges in such a zone of unfragmented formation.

2. The method according to claim 1 additionally comprising forming a fracture between the top portion of the pillar and the overlying zone of unfragmented formation prior to detonating explosive charges for explosively expanding such a first segment of the middle portion of the pillar.

3. The method according to claim 1 additionally comprising forming a fracture between the top portion of the pillar and the overlying zone of unfragmented formation and forming a fracture between the bottom portion of the pillar and the underlying zone of unfragmented formation, wherein both such fractures are formed prior to detonating explosive charges for explosively expanding such a first segment of the middle portion of the pillar.

4. The method according to claim 1 wherein the roof of the uppermost void formed in the subterranean formation is the top boundary of the retort being formed, the method additionally comprising placing a plurality of rock bolts into the zone of unfragmented formation overlying the uppermost void at angles toward such a support pillar in the uppermost void so that at least a portion of such rock bolts converge in the formation directly above the pillar.

5. The method according to claim 1 wherein all of the explosive charges in the pillar provided for explosively expanding the pillar and the explosive charges in such a zone of unfragmented formation adjacent the pillar are detonated in a single round.

6. The method according to claim 5 wherein the explosive charges in the pillar provided for explosively expanding the pillar form a square array and all of the explosive charges in the middle portion of the pillar are detonated first followed after a selected time delay by detonation of all of the explosive charges in both the top and bottom portions.

7. The method according to claim 6 wherein the selected time delay is from about 1 millisecond to about 10 milliseconds per foot of spacing distance between explosive charges in the square array.

8. The method according to claim 1 wherein the explosive charges in the middle portion of the pillar are more energetic than the explosive charges in either the top or bottom portions of the pillar.

9. A method for forming an in situ oil shale retort in a retort site in a subterranean formation containing oil shale, the in situ oil shale retort containing a fragmented permeable mass of formation particles containing oil shale within top, bottom, and generally vertically extending side boundaries of unfragmented formation, the method comprising the steps of:

(a) excavating at least one void within the retort boundaries in the subterranean formation while leaving zones of unfragmented formation above and below such a void and at least one support pillar of unfragmented formation in the void, the top of the support pillar adjoining the zone of unfragmented formation overlying the void and the bottom of the support pillar adjoining the zone of unfragmented formation underlying the void;

(b) placing explosive charges into at least one of the zones of unfragmented formation for explosively expanding such a zone of unfragmented formation toward the void;

(c) preparing the support pillar for explosive expansion into the void by a method comprising the steps of:

(i) drilling an array of spaced apart generally horizontally extending blastholes into the pillar, the blasthole array comprising a first row of generally horizontally extending primary blastholes along the length of the top portion of the pillar, a second row of generally horizontally extending primary blastholes along the length of the bottom portion of the pillar and at least one intermediate row of generally horizontally extending primary blastholes along the length of a middle portion of the pillar between the first and second rows; and (ii) placing explosive charges into the blastholes in the pillar; and (d) detonating the explosive charges to thereby form the fragmented permeable mass of formation particles in the retort by the steps of:

(i) detonating all of the explosive charges in at least one of such intermediate rows of primary blastholes to thereby explosively expand at least a first segment of the middle portion of the pillar toward the void, the first segment being substantially an entire horizontal cross section of the pillar; thereafter (ii) detonating the remaining explosive charges in the primary blastholes in the pillar to explosively expand the remaining portions of the pillar toward the void; and thereafter (iii) detonating the explosive charges in such a zone of unfragmented formation to explosively expand the zone of unfragmented formation toward the void.

10. The method according to claim 9 additionally comprising:

(a) drilling a row of generally horizontally extending secondary blastholes along the length of the pillar between the first row of primary blastholes and the top of the pillar;

(b) placing explosive charges into the secondary blastholes; and (c) detonating all of the explosive charges in the row of secondary blastholes to thereby form a fracture between the top of the pillar and overlying unfragmented formation prior to detonating any of the explosive charges in the primary blastholes.

11. The method according to claim 9 additionally comprising:

(a) drilling a first row of generally horizontally extending secondary blastholes along the length of the pillar between the first row of primary blastholes and the top of the pillar;

(b) drilling a second row of generally horizontally extending secondary blastholes along the length of the pillar between the second row of primary blastholes and the bottom of the pillar; and (c) detonating all of the explosive charges in the first row of secondary blastholes to thereby form a fracture between the top of the pillar and overlying unfragmented formation and detonating all of the explosive charges in the second row of secondary blastholes to thereby form a fracture between the bottom of the pillar and underlying unfragmented formation, wherein all of the explosive charges in the first and second rows of secondary blastholes are detonated before any of the explosive charges in the primary blastholes are detonated.

12. The method according to claim 9 wherein the explosive charges in each such intermediate row of generally horizontally extending primary blastholes are more energetic than the explosive charges in the first and second rows of generally horizontally extending primary blastholes.

13. The method according to claim 9 wherein each such support pillar comprises at least one pair of generally vertical free faces on its opposite sides and wherein the axes of the primary blastholes in the pillar are substantially perpendicular to one of the opposed pillar free faces.

14. The method according to claim 9 wherein the roof of the uppermost void formed in the subterranean formation is the top boundary of the retort being formed, the method additionally comprising placing a plurality of rock bolts into the zone of unfragmented formation overlying the uppermost void at angles toward such a support pillar located in the uppermost void so that at least a portion of such rock bolts converge in the formation directly above the pillar.

15. The method according to claim 9 wherein the explosive charges in the primary blastholes in the pillar and the explosive charges in such a zone of unfragmented formation are all detonated in a single round.

16. The method according to claim 15 wherein the array of spaced apart horizontally extending blastholes in the pillar comprises only one intermediate row of primary blastholes, the distance from the first row of primary blastholes to the intermediate row of primary blastholes being about equal to the distance from the second row of primary blastholes to the intermediate row of primary blastholes, the method comprising detonating all of the explosive charges in the intermediate row of primary blastholes at about the same time and after a selected time delay detonating all of the explosive charges in the first and second rows of primary blastholes at about the same time.

17. The method according to claim 16 wherein the selected time delay is from about one millisecond to about ten milliseconds per foot of distance between either of the first and second rows of primary blastholes and the intermediate row of primary blastholes.

18. A method for forming an in situ oil shale retort in a retort site in a subterranean formation containing oil shale, the in situ retort containing a fragmented permeable mass of formation particles containing oil shale within top, bottom, and generally vertically extending side boundaries of unfragmented formation, the method comprising the steps of:

(a) excavating a void within the retort boundaries in the subterranean formation while leaving zones of unfragmented formation above and below the void and at least one support pillar of unfragmented formation in the void, the roof of the void being the top boundary of the retort being formed and the floor of the void being the top surface of the underlying zone of unfragmented formation, the support pillar comprising three vertically spaced portions wherein each such portion comprises the entire horizontal cross section of the pillar, a top portion adjoining the void roof, a bottom portion adjoining the void floor and a middle portion extending between the top and bottom portions;

(b) placing explosive charges into the underlying zone of unfragmented formation for explosively expanding the underlying zone toward the void;

(c) placing explosive charges into the top, bottom and middle portions of the pillar for explosively expanding the pillar toward the void;

(d) detonating explosive charges in such a middle portion of the pillar to thereby explosively expand at least a first segment of the middle portion of the pillar toward the void, the first segment being substantially an entire horizontal cross section of the middle portion of the pillar; thereafter (e) detonating all of the remaining explosive charges in the pillar; and thereafter (f) detonating the explosive charges in the zone of unfragmented formation.

19. The method according to claim 18 additionally comprising placing a plurality of rock bolts into the void roof at angles toward such a pillar so that at least a portion of such rock bolts converge in the formation overlying the pillar.

20. The method according to claim 18 additionally comprising forming a fracture between the top portion of the pillar and the void roof prior to detonating explosive charges for explosively expanding such a first segment of the middle portion of the pillar.

21. The method according to claim 18 additionally comprising forming a fracture between the top portion of the pillar and the void roof and forming a fracture between the bottom portion of the pillar and the void floor, wherein both such fractures are formed prior to detonating explosive charges for explosively expanding such a first segment of the middle portion of the pillar.

22. The method according to claim 18 wherein all of the explosive charges in the pillar provided for explosively expanding the pillar and all of the explosive charges in the underlying zone of unfragmented formation are detonated in the same single round.

23. The method according to claim 22 wherein the explosive charges in the pillar provided for explosively expanding the pillar form a square array and all of the explosive charges in the middle portion of the pillar are detonated first followed after a selected time delay by detonation of all of the explosive charges in both the top and bottom portions.

24. The method according to claim 23 wherein the selected time delay is from about 1 millisecond to about 10 milliseconds per foot of spacing distance between explosive charges in the square array.

25. The method according to claim 18 wherein the explosive charges in the middle portion of the pillar are more energetic than the explosive charges in either the top or bottom portions of the pillar.

26. A method for forming an in situ oil shale retort in a retort site in a subterranean formation containing oil shale, the in situ oil shale retort containing a fragmented permeable mass of formation particles containing oil shale within top, bottom and generally vertically extending side boundaries of unfragmented formation, the method comprising the steps of:

(a) excavating a void within the retort boundaries in the subterranean formation while leaving zones of unfragmented formation above and below the void and at least one support pillar of unfragmented formation in the void, the roof of the void being the top boundary of the retort being formed and the floor of the void being the top surface of the underlying zone of unfragmented formation, the top of such a pillar adjoining the void roof and the bottom of such a pillar adjoining the void floor;

(b) placing explosive charges into the underlying zone of unfragmented formation for explosively expanding the zone of unfragmented formation toward the void;

(c) preparing the support pillar for explosive expansion into the void by a method comprising the steps of:

(i) drilling an array of spaced-apart generally horizontally extending blastholes into the pillar, the blasthole array comprising a first row of generally horizontally extending primary blastholes along the length of the top portion of the pillar and a second row of generally horizontally extending primary blastholes along the length of the pillar adjacent and below the first row of primary blastholes; and (ii) placing explosive charges into the primary blastholes in the pillar; and (d) detonating the explosive charges to thereby form the fragmented permeable mass of formation particles in the retort by the steps of:

(i) detonating all of the explosive charges in the second row of primary pillar blastholes to thereby explosively expand a first segment of the pillar toward the void, the first segment comprising substantially an entire horizontal cross section of the pillar; thereafter, (ii) detonating all of the explosive charges in the first row of primary pillar blastholes; and thereafter (iii) detonating the explosive charges in the underlying zone of unfragmented formation.

27. The method according to claim 26 additionally comprising:

(a) drilling a row of generally horizontally extending secondary blastholes along the length of the pillar between the first row of primary blastholes and the top of the pillar;

(b) placing explosive charges into the secondary blastholes; and (c) detonating all of the explosive charges in the row of secondary blastholes to thereby form a fracture between the top of the pillar and overlying unfragmented formation before any of the explosive charges in the primary blastholes are detonated.

28. The method according to claim 26 additionally comprising:

(a) drilling a first row of generally horizontally extending secondary blastholes along the length of the pillar between the first row of primary blastholes and the top of the pillar;

(b) drilling a second row of generally horizontally extending secondary blastholes adjacent the bottom of the pillar; and (c) detonating all of the explosive charges in the first row of secondary blastholes to thereby form a fracture between the top of the pillar and overlying unfragmented formation and detonating all of the explosive charges in the second row of secondary blastholes to thereby form a fracture between the bottom of the pillar and underlying unfragmented formation, wherein all of the explosive charges in both the first and second rows of secondary blastholes are detonated before any of the explosive charges in the primary blastholes are detonated.

29. The method according to claim 26 wherein the explosive charges in the first row of primary blastholes are less energetic than the explosive charges in the second row of primary blastholes.

30. The method according to claim 26 wherein each support pillar comprises at least one pair of generally vertical free faces on its opposite sides and the axes of the primary blastholes in the pillar are substantially perpendicular to one of the opposed free faces.

31. The method according to claim 26 wherein the explosive charges in the primary blastholes in the pillar and in the underlying zone of unfragmented formation are detonated in a single round.

32. The method according to claim 31 comprising detonating all of the explosive charges in the second row of primary blastholes at about the same time, and after a selected time delay, detonating all of the explosive charges in the first row of primary blastholes at about the same time.

33. The method according to claim 32 wherein the selected time delay is from about one millisecond to about ten milliseconds per foot of distance between the first and second rows of primary blastholes.

34. The method according to claim 26 additionally comprising placing a plurality of rock bolts into the void roof at angles toward such a support pillar so that at least a portion of such rock bolts converge in the formation directly above the pillar.

35. A method for forming an in situ oil shale retort in a retort site in a subterranean formation containing oil shale, the in situ oil shale retort containing a fragmented permeable mass of formation particles containing oil shale within top, bottom and generally vertically extending side boundaries of unfragmented formation, the method comprising the steps of:

(a) excavating a void within the retort boundaries in the subterranean formation while leaving zones of unfragmented formation above and below the void and at least one support pillar of unfragmented formation in the void, the roof of the void being the top boundary of the retort being formed and the floor of the void being the top surface of the underlying zone of unfragmented formation, the top of such a pillar adjoining the void roof and the bottom of such a pillar adjoining the void floor;

(b) placing explosive charges into the underlying zone of unfragmented formation for explosively expanding the underlying zone toward the void;

(c) placing a plurality of rock bolts into the roof of the void at angles toward such a pillar so that at least a portion of such rock bolts converge in the formation directly above the pillar;

(d) placing a plurality of explosive charges into the pillar for expanding the pillar toward the void; and thereafter (e) detonating the explosive charges to thereby form the fragmented permeable mass of formation particles in the retort by the steps of:

(i) detonating all of the explosive charges in the pillar; and thereafter (ii) detonating the explosive charges in the underlying zone of unfragmented formation.

36. The method according to claim 35 additionally comprising forming a fracture between the top of such a pillar and the void roof prior to detonating explosive charges for explosively expanding the pillar toward the void.

37. The method according to claim 35 comprising forming a fracture between the top of such a pillar and the void roof and forming a fracture between the bottom of such a pillar and the void floor, wherein both such fractures are formed prior to detonating explosive charges for explosively expanding the pillar toward the void.

38. The method according to claim 35 wherein the plurality of explosive charges in the pillar are in an array comprising a first row of generally horizontally extending explosive charges along the length of the top portion of the pillar and a second row of generally horizontally extending explosive charges along a length of the pillar adjacent and below the first row of explosive charges; wherein the explosive charges in the pillar are detonated in a single round comprising the steps of:

detonating all of the explosive charges forming the second row of explosive charges to thereby explosively expand a first segment of the pillar toward the void, the first segment comprising substantially an entire horizontal cross section of the pillar; and thereafter detonating all of the explosive charges in the first row of explosive charges.

39. The method according to claim 38 wherein the explosive charges comprising the first row of explosive charges in the pillar are less energetic than the explosive charges comprising the second row of explosive charges in the pillar.

40. The method according to claim 38 wherein the array additionally comprises a third row of generally horizontally extending explosive charges along the length of the bottom portion of the pillar, the second row of charges being between the first and third rows and along the length of a middle portion of the pillar, all of the explosive charges in the third row being detonated at about the same time that the explosive charges in the first row are detonated.

41. A method for forming an in situ oil shale retort in a retort site in a subterranean formation containing oil shale, the in situ oil shale retort containing a fragmented permeable mass of formation particles containing oil shale within top, bottom and generally vertically extending side boundaries of unfragmented formation, the method comprising the steps of:

(a) excavating at least one void within the retort boundaries in the subterranean formation while leaving zones of unfragmented formation above and below such a void and at least one support pillar of unfragmented formation in the void, such a support pillar comprising three vertically spaced portions wherein each such portion comprises an entire horizontal cross section of the pillar, a top portion adjoining the overlying zone of unfragmented formation, a bottom portion adjoining the underlying zone of unfragmented formation and a middle portion extending between the top and bottom portions;

(b) placing explosive charges into at least one of the zones of unfragmented formation for explosively expanding such a zone toward the void;

(c) placing explosive charges into the top, bottom and middle portions of the pillar for explosively expanding the pillar toward the void, the explosive charges in the middle portion of the pillar being more energetic than the explosive charges in either the top or bottom portions;

(d) detonating the explosive charges to thereby form the fragmented permeable mass of formation particles in the retort by the steps of:

(i) detonating all of the explosive charges in the pillar; and thereafter (ii) detonating the explosive charges in such a zone of unfragmented formation.

42. The method according to claim 41 comprising detonating the explosive charges to form the fragmented permeable mass of formation in the retort by the steps of:

(a) detonating explosive charges in a middle portion of the pillar to thereby explosively expand at least a first segment of the middle portion toward the void, the first segment being substantially an entire horizontal cross section of the middle portion; thereafter (b) detonating all of the remaining explosive charges in the pillar; and thereafter (c) detonating the explosive charges in such a zone of unfragmented formation.

43. The method according to claim 41 additionally comprising forming a fracture between the top portion of the pillar and the overlying zone of unfragmented formation prior to detonating explosive charges in the pillar for explosively expanding the pillar.

44. The method according to claim 41 additionally comprising forming a fracture between the top portion of the pillar and the overlying zone of unfragmented formation and forming a fracture between the bottom portion of the pillar and the underlying zone of unfragmented formation, wherein both such fractures are formed prior to detonating explosive charges for explosively expanding such a pillar.

45. The method according to claim 41 wherein the roof of the uppermost void formed in the subterranean formation is the top boundary of the retort being formed, the method additionally comprising placing a plurality of rock bolts into the zone of unfragmented formation overlying the uppermost void at angles toward such a support pillar in the uppermost void so that at least a portion of such rock bolts converge in the formation directly above the pillar.

46. The method according to claim 41 wherein all of the explosive charges in the pillar provided for explosively expanding the pillar and the explosive charges in such a zone of unfragmented formation adjacent the pillar are detonated in a single round.

47. The method according to claim 46 wherein the explosive charges in the pillar provided for explosively expanding the pillar form a square array and all of the explosive charges in the middle portion of the pillar are detonated first followed after a selected time delay by detonation of all of the explosive charges in both the top and bottom portions.

48. The method according to claim 47 wherein the selected time delay is from about 1 millisecond to about 10 milliseconds per foot of spacing distance between explosive charges in the array.

* * * * *